United States Patent [19]

Doan

[11] 3,975,862

[45] Aug. 24, 1976

[54] HANGING OF SLIDING DOORS

[76] Inventor: Troy L. Doan, 924 Phillips, Vista, Calif. 92083

[22] Filed: June 12, 1975

[21] Appl. No.: 586,236

[52] U.S. Cl. ..... 49/409; 16/96 R

[51] Int. Cl.[2] ..... E05D 13/02

[58] Field of Search ..... 49/409–411, 49/125; 16/87 B, 94 R, 96 R; 4/149

[56] References Cited

UNITED STATES PATENTS

| | | | |
|---|---|---|---|
| 259,716 | 6/1882 | Prescott | 49/411 |
| 3,642,051 | 2/1972 | Goldner | 49/125 |

*Primary Examiner*—Kenneth Downey

*Attorney, Agent, or Firm*—Duane C. Bowen

[57] ABSTRACT

Two sliding doors are supported to hang vertically, without floor guides for their lower edges, by offsetting the planes of the doors relative to the planes of the supporting tracks in directions so that the lower portions of the doors press towards each other. Intermediate doors, in three or more door assemblies, may be supported to hang vertically. Arms, attached to doors and supporting rollers bearing on the tracks, are interfingered, thereby avoiding general arm interference and maintaining lapping of doors.

10 Claims, 5 Drawing Figures

HANGING OF SLIDING DOORS

BRIEF SUMMARY OF THE INVENTION AND OBJECTIVES

My invention relates to the hanging of sliding doors without door guides on the floor.

In conventional practice, sliding doors are provided with floor guides in order to maintain the doors in vertical orientation and to prevent inward or outward swinging. It would be advantageous to avoid the necessity of having floor guides because they involve extra costs in terms of hardware and installation expenses and because floor guides are not an attractive feature, etc. To illustrate the installation problem in closet door hanging in a new house with a concrete slab floor, commonly the doors will not be fitted until the late stages of house construction, frequently after rug installation. This means the rug has to be cut and the slab has to be drilled in order to secure the floor guiding means. The carpenter has to make measurements for guide location. To the extent a metal threshold type guide is used, extending completely across the closet opening, this is not only expensive and adds nothing to appearance, but it is also uncomfortable to step on and particularly in a walk-in closet, presents an extra cleaning problem, etc. Without belaboring the matter, it would appear to be preferable to have no floor guides because of the above and other considerations and it is an object of my invention to provide for the hanging of sliding doors without guides for the lower edges thereof.

If only a central guide is used on the floor, adapting door lengths is a problem particularly when a thick carpet is used such as a shag carpet, i.e., the central guide is secured to the floor and the door lengths must be such as to clear the top of the carpet and to still engage the central guide which must extend from the floor to a point somewhat above the top of the carpet.

Further objectives of my invention include: to devise a way to hang sliding doors in which they are more stably disposed in vertical orientation than by merely superposing the track to the door, and, more particularly, to provide for such stable vertical positioning by offsetting the planes of the tracks to the planes of the doors, to devise solutions to problems associated with the offset track concept, to improve the appearance of sliding closet door assemblies and the like, to avoid floor obstacles especially in walk-in closets, and to provide the above in a structure simple to manufacture and install and operating reliably.

My invention will be best understood, together with additional objectives and advantages thereof, from the following description, read with reference to the drawings, in which.

Figure 1:
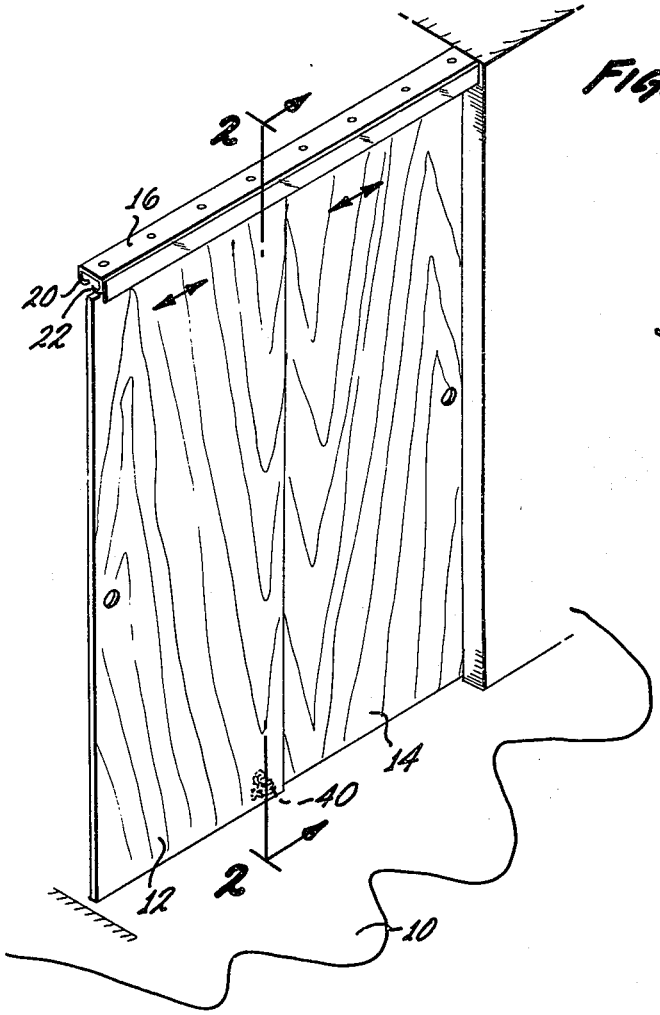
FIG. 1 is a perspective view of an installation showing a specific embodiment of my invention in which two doors are supported from track means. Some structure is cut away to better show the invention.
Figure 2:
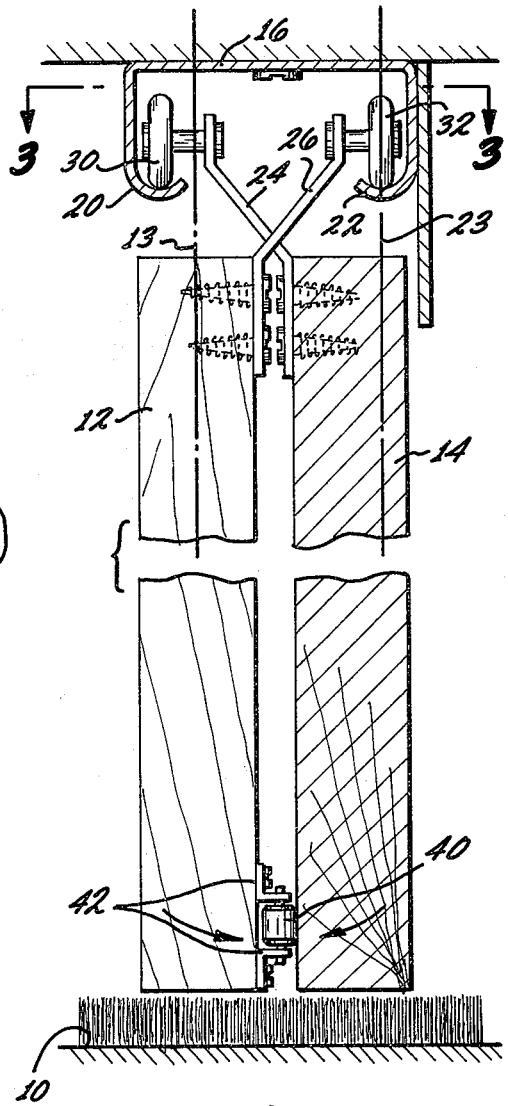
FIG. 2 is an end view, enlarged, broken and partly in section, taken on line 2—2 of FIG. 1.
Figure 3:
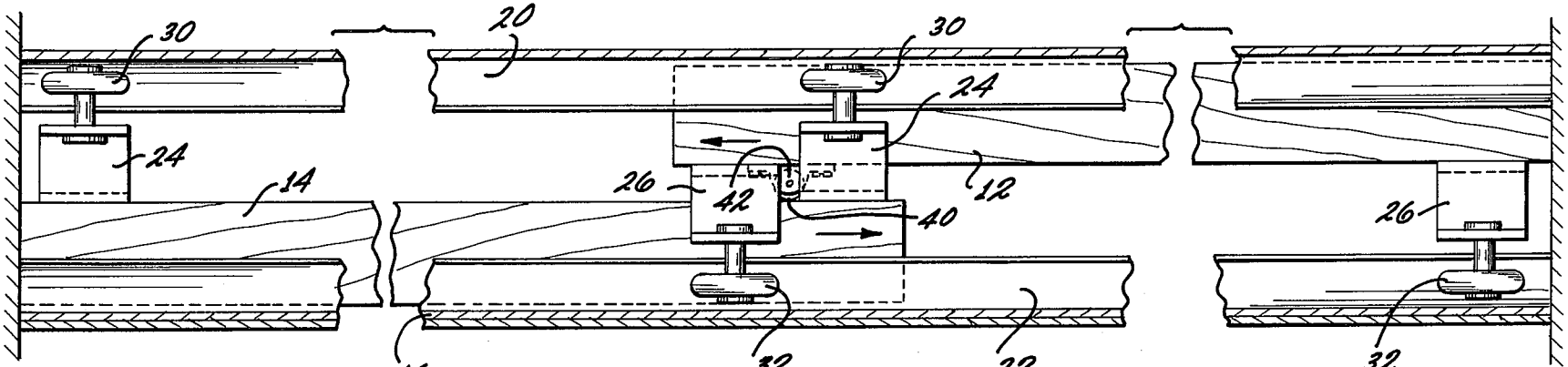
FIG. 3 is a plan view, broken and partly in section, taken on line 3—3 of FIG. 2.

Referring first to FIGS. 2 and 3, two sliding doors 12, 14 are shown. These may be made of various materials, i.e., wood, metal, plastic or glass. Some doors have central sheet panels supported by side, top and bottom frames, such as translucent sheets set in metal frames often found in shower or bath sliding doors. My invention applies to doors made of various materials but it would appear that the doors would need to be rigid, i.e., I am dealing with paired doors that more or less lap in their various positions, as distinguished, for example, from accordion doors in which usually one door is used for an opening and which collapses or folds to open.

In order to describe the location of the tracks relative to the doors, I will use the expression "central upright plane" of each door. As will later appear, the tracks are offset from the central upright plane of the associated doors. Such central upright plane is shown by dashed lines 13 as to door 12 in FIG. 2. Although the tracks usually will be offset farther from the associated doors, I use the expression "central upright plane" of the doors to distinguish other planes through the doors, i.e., a track could be in the plane of one face of the door but still be offset relative to the central upright plane of the door, which usually will be the site of the center of gravity of the door. If the door were made from a series of plies, the central upright plane would correspond with the central ply.

Sliding doors like those illustrated at 12, 14 are used for various openings and in various structures, but one of the most common uses at present is for closets in residences and often the doors extend to the ceiling. For most purposes of doors in building interiors, there is no advantage to having any guide on the floor or other surface 10 below the doors, as such a guide to maintain the doors in position represents additional expense in hardware and installation, adds nothing to appearance or could be considered unsightly, etc., as previously discussed. (In an exterior application, bottom guides could be desirable for security reasons.) The purpose of such bottom guides in interior applications is usually to maintain the doors in their normal vertical positions as against swinging as they are touched and particularly as they are manipulated in opening and closing. Such swinging would be annoying if excessive and could result in roller escape from tracks if excessive. As in prior practice doors have been supported from tracks directly overhead, there was nothing to keep them from swinging due to forces applied to them to the extent they were not held in place by guides acting on their lower edges. As will appear hereafter, doors hung according to my invention have more resistance to displacement out of vertical orientations than with conventionally hung doors.

Track 16 may have various shapes but that shown in FIG. 2 is representative. A pair of tracks 20, 22 are shown as being formed by inturned, curved flanges. The vertical planes which contain tracks 20, 22 can be considered to be those intersecting the bases of the tracks, i.e., the lowest points in their concave upper faces. This is illustrated by the dashed line 23 as to track 22 in FIG. 2.

Arms 24, 26 suitably attached to doors 14, 12, respectively, support rollers 30, 32, respectively, which are engaged in tracks 20, 22, respectively. Although this type of support is normally termed "sliding," the term is something of a misnomer as the action of the doors would be more accurately termed "rolling." Although possibly in quite light and small doors such as in some cabinets, a type of sliding surface could be used in a track, use of other than rollers is a dubious choice in any installation due to the difficulty of obtaining sufficiently low friction.

The offsetting of the central upright plane 13 of door 12 from the vertical plane 23 of track 22 illustrates the type of offset door support used in my invention although the distance of the offset may vary. With the doors 12, 14 supported in this manner, the lower portions of the doors will tend to swing against each other with forces determined by the weights and moment arms involved. As the doors 12, 14 usually will be identical and the offset between the doors and their supporting tracks will be identical, the forces exerted by the lower portions of the doors on each other will be equal. As will later be described, I use an abutment between the doors to maintain the same spacing therebetween at their lower portions as at their upper portions. With this spacing means provided, the equal force applied by each door on the other will mean that the doors will tend to hang in vertical positions.

At this point I will discuss the question of how the type of sliding door hanging shown in the drawings acts differently than doors, according to prior practices, hung from tracks immediately overhead. As before indicated, floor guides are used to prevent swinging of doors when they are manually manipulated such as in opening and closing. If the doors were to swing too easily in or out, this would be annoying or even risk rollers becoming disengaged from the tracks. My approach is that the doors do not have to be maintained strictly in vertical planes as long as they do not swing in and out too easily or too far. Apparently a proper analysis would follow the technology of mechanics, that would generally apply except for matters such as frictional factors, which in this case would partly involve the drag of the abutment between doors, described later in this description. I have tested the invention described with a model but my knowledge of mechanics, inertia, frictional subjects, etc., is limited, so I will not try to deal with those subjects in detail and I acknowledge the limitations of my information in those regards.

I think the occasion in which door swinging is most likely to be a problem is when a single door is being manipulated, i.e., when the doors have minimum or partial overlapping, such as when closet doors are closed and one door is manipulated to open the same. It appears that the force applied by gravity to each door could be determined by measuring the distance of the vertical plane containing its center of gravity from the vertical plane of the supporting track, i.e., in the static position of FIG. 2, the distance between planes 13 and 23 would be the moment arm of gravity acting on door 12. If door 12 were manually forced to the left as viewed in FIG. 2, when the center of gravity of door 14 (following door 12 and applying pressure thereto) reached a point directly under track 20, its moment arm relative to gravity would be zero. If the centers of tracks 20, 22 were separated 2 inches and each door weighed 25 pounds, door 12 (dispaced 4 inches from the vertical plane 23 of track 22) would have a restoring force at that point (or have a resistance to that much displacement) of 8⅓ foot-pounds. If door 12 were instead directly hung from a track immediately overhead and were displaced the same 2 inches, door 12 at that point would have a restoring force (or resistance to that much displacement) of 4 and 1/6 foot-pounds. These calculations do not take into account any factors other than static mechanics, i.e., friction, inertia, etc.

The above figures seem to demonstrate a substantial difference between my door support system and prior door support systems. I think the friction of abutment means, etc., may also be a factor of importance. I will not discuss the action of the doors as they are manipulated together, i.e., if door 14 were forced along with door 12 to the left in FIG. 2, but results may follow the above discussion. Note that whether door 12 or door 14 is subjected to the force, door 14 is applying a force to the left until such time as the center of gravity reaches a point in the plane of track 20. I have made a static rather than a dynamic analysis, and dynamics may or may not have a material effect.

The doors perferably have abutment means between their lower faces, to maintain the spacing therebetween throughout their vertical extents, as indicated in FIG. 2. The top door spacing is determined by the spacing of tracks 20, 22 and by the shape and dimensions of arms 24, 26, and the abutment means merely follows that spacing. In the structure shown in FIG. 2, as well as in FIG. 3, the abutment means between the opposed faces of the doors has the form of a roller 40 bearing on the face of door 14 and supported to rotate about a vertical axis by bracket means 42 appropriately secured to door 12. Some resistance to swinging of the doors is provided by the friction of the face of roller 40 sliding on the face of door 14. If it were desired to limit swinging by the abutment means, roller 40 could instead be received in a channel-shaped extrusion attached to door 14 or the extrusion could even be shaped to prevent roller or other abutment escape.

As indicated by FIG. 3, arms 24, 26 are interfingered. Door 12 has two arms 26 and door 14 has two arms 26, each located near an edge of the respective door. By interfingering as shown in FIG. 3, arms 24, 26 do not interfere except if the user tried to orient them in 100% juxtaposed, lapped position, and the interfingering avoids any possibility that the doors could assume an unlapped position (if that were possible in the particular installation.) Note also from FIG. 3 that roller 40 should be positioned near the edges of the doors that are always maintained in lapped position.

Figure 4:
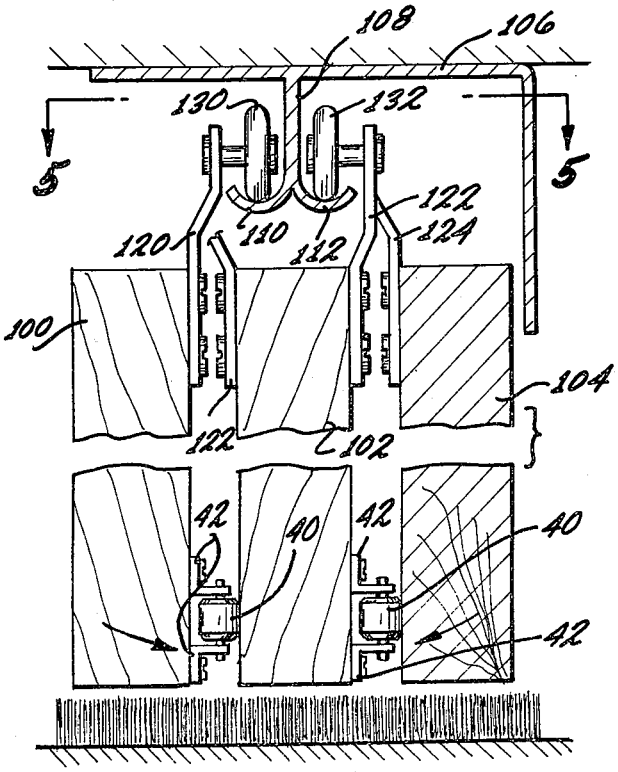
FIG. 4 is a view like that of FIG. 2, only being of a three door installation.

FIG. 4 shows a modification applicable to three lapped doors. From the combined showing of the drawings, application to four or more doors can follow the principles of the various drawings, i.e., the series type connection of FIGS. 2 and 3 could be further extended for three or more doors or the FIGS. 5 and 4 system could be adapted for more than one "intermediate" door.

Doors 100 and 104 more or less correspond to doors 12, 14 and door 102 is intermediate doors 100, 104. Track 106 could have different forms but that shown has a central inverted-T-shaped extrusion 108 forming two arms or flanges 110, 112 providing tracks for doors 100, 104 respectively. The tendency of doors 100, 104 to swing towards each other about the pivots formed by tracks 110, 112, respectively, corresponds to the tendency of doors 12, 14 to pivot about tracks 22, 20, respectively. Door 102 could be supported on a separate track but I have elected to support door 102 on tracks 110, 112.

Figure 5:
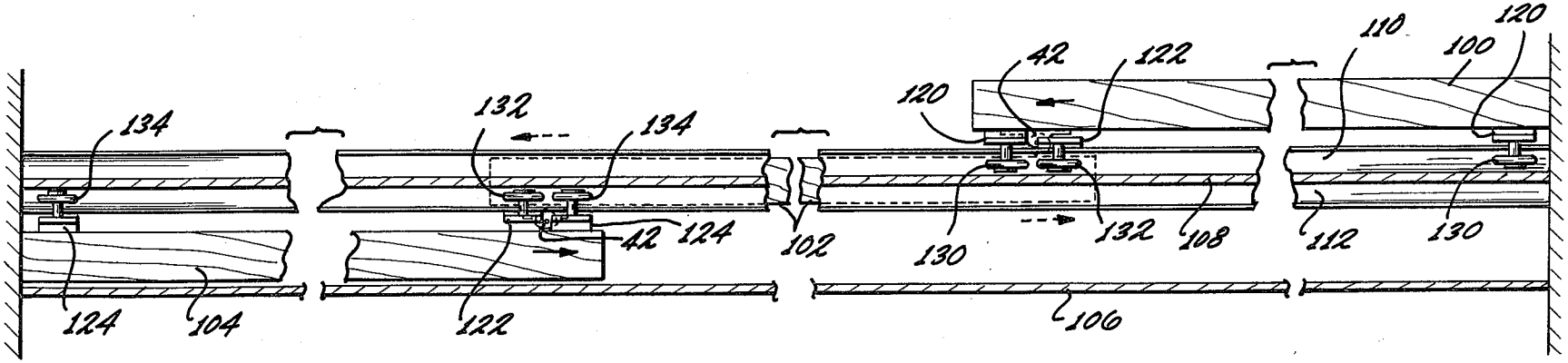
FIG. 5 is like FIG. 3, only being of the three door installation, the view being taken on line 5—5 of FIG. 4.

Arms 120, 122, 124 on doors 100, 102, 104 have rollers 130, 132, 134 engaged with tracks 110, 112. The interfingering of arms 120, 122, 124 is depicted in FIG. 5 and this is generally like the interfingering of arms 24, 26 in FIG. 3 and for like reasons.

Door 102 has one roller 132 engaged in track 110 and one roller 132 engaged in track 112 so that it is supported to hang vertically. The action of the combined doors under force tending to pivot them out of vertical orientations is much the same as with doors 12, 14 in FIG. 2. Door 102 can be thought of as having less resistance to being pivoted out of normal (neutral) position than is the case with doors 100, 104, insofar as the applied force is against the bias of doors 100, 104.

I have shown the same type of rollers 40 and supporting brackets 42 between doors 100 and 102 and between doors 102 and 104 as was described in connection with doors 12, 14. In connection with both the two door and three or more door installations, note that a type of sliding, spacing abutment could be substituted for rollers 40, i.e., a plastic spacing block.

Having thus described my invention, I do not wish to be understood as limiting myself to the exact details of construction illustrated. Instead, I wish to cover those modifications which will occur to those skilled in the art upon learning of my invention and which properly fall within the scope of my invention.

I claim:

1. The improvement in a sliding door assembly in which at least first and second similar sliding doors are hung by roller means depending from track means, comprising:

a. said track means including at least first and second spaced apart tracks, said first door being hung by its roller means solely from said first track and said second door being hung by its roller means solely from said second track, b. each door being hung with its central upright plane spaced from the vertical plane which includes the track from which it is hung so that the lower margin of the door will tend to swing toward that vertical plane, and c. the vertical plane which includes said first track being spaced from the central upright plane of said first door in the direction of the central upright plane of the second door and the vertical plane which includes said second track being spaced from the central upright plane of said second door in the direction of the central upright plane of the first door, whereby the lower margins of said doors tend to swing into abutment and whereby said doors tend to be stabilized in normal position in generally vertical orientation with their lower margins pressed against each other with equal forces, and said doors have combined resistance to displacement of the lower portions of the doors from said normal position in directions normal to said planes due to shifts of door centers of gravity in a manner having combined resistance to that displacement, without a requirement for door guides therebelow.

2. The subject matter of claim 1 in which the roller means for each door includes a roller near each end of that door and an arm attached to that door supporting each roller, said arms of said doors being interfingered by one arm of said first door being disposed between the arms of said second door and by one arm of said second door being disposed between the arms of said first door whereby said arms can be accommodated without interference in most positions of said doors and whereby said doors can not move out of abutment of their lower margins.

3. The subject matter of claim 1 in which there is at least one abutment attached to at least one of said doors abutting against the lower portion of the other door spacing apart the lower margins of said doors a distance such that said doors will be vertically oriented in said normal position thereof.

4. The subject matter of claim 3 in which said abutment is a roller attached to one door and bearing on the other door providing antifrictional contact therebetween.

5. The improvement in a sliding door assembly in which first and second sliding doors and at least one intermediate sliding door are hung by roller means depending from track means, comprising:

a. said intermediate door being hung from said track means with its central upright plane between the central upright planes of said first and second doors and said intermediate door at least partly lapping said first and second doors in all positions thereof, said intermediate door being hung by its roller means in a balanced position relative to the track means so as to normally assume a vertical disposition, b. said track means including at least first and second spaced apart tracks, said first door being hung by its roller means solely from said first track and said second door being hung by its roller means solely from said second track, c. each of said first and second doors being hung with its central upright plane spaced from the vertical plane which includes the track from which it is hung so that the lower margin of the door will tend to swing toward that vertical plane, and d. the vertical plane which includes said first track being spaced from the central upright plane of said first door in the direction of the central upright plane of the second door and the vertical plane which includes said second track being spaced from the central upright plane of said second door in the direction of the central upright plane of the first door, whereby the lower margins of said doors tend to swing into abutment with said intermediate door and whereby the doors tend to be stabilized in normal position in generally vertical orientation with their lower margins pressed against each other and said doors have combined resistance to displacement of the lower portions of the doors from said normal position in directions normal to said planes due to shifts of door centers of gravity in a manner having combined resistance to that displacement.

6. The subject matter of claim 5 in which there is at least one abutment between said first door and said intermediate door and between said second door and said intermediate door spacing apart the lower margins of said doors a distance such that said doors will be vertically oriented in said normal position thereof.

7. The subject matter of claim 6 in which each abutment is a roller attached to one door and bearing on another door providing antifrictional contract therebetween.

8. The subject matter of claim 5 in which the roller means for each door includes a roller near each end of that door and an arm attached to that door supporting each roller, a first roller of said intermediate door bearing on said first track and a second roller of said intermediate door bearing on said second track, said arms of said doors being interfingered by the arm attached to said first roller of said intermediate door being positioned between said arms of said first door and the arm attached to said second roller of said intermediate door being positioned between said arms of said second door whereby said arms can be accommodated without interference in most positions of said doors and whereby said doors can not move out of abutment of their lower margins.

9. The subject matter of claim 1 in which said vertical plane including said first track is on the opposite side of said central upright plane of said second door from said central upright plane of said first door, and in which said vertical plane including said second track is on the opposite side of said central upright plane of said first door from said central upright plane of said second door.

10. The subject matter of claim 5 in which said track means has an inverted-T-shape forming two oppositely disposed flanges and one flange forming said first track and the other flange forming said second track, said roller means of said intermediate door including a roller near each end of said intermediate door and an arm attached to said intermediate door supporting each roller, one of said rollers of said intermediate door bearing on said first track and the other of said rollers of said intermediate door bearing on said second track.

* * * * *